US005237303A

United States Patent [19]

Kicherer et al.

[11] Patent Number: 5,237,303

[45] Date of Patent: Aug. 17, 1993

[54] DEVICE FOR CONTROLLING AN AMBIENT INFLUENCE ON EQUIPMENT

[76] Inventors: Robert Kicherer, Amselrain 47, 7519 Oberderdingen; Siegfried Mannuss, Kilgenweg 17-19, 7137 Sternenfels; Willi Reichert, Schillerstrasse 12, 7519 Kuernbach, all of Fed. Rep. of Germany

[21] Appl. No.: 776,657

[22] Filed: Oct. 15, 1991

[30] Foreign Application Priority Data

Oct. 17, 1990 [DE] Fed. Rep. of Germany ..... 4032942

[51] Int. Cl.[5] ..... H01H 61/08; H01H 71/22

[52] U.S. Cl. ..... 337/99; 337/57; 337/94; 337/361

[58] Field of Search ..... 337/99, 57, 64, 82, 337/94, 347, 353, 360, 361, 368, 378, 92, 93

[56] References Cited

U.S. PATENT DOCUMENTS 3,634,802 11/1972 Aldous ..... 337/93
4,829,279 5/1989 Kicherer et al. ..... 337/94

FOREIGN PATENT DOCUMENTS 0043577 1/1982 European Pat. Off. .
3103561 2/1981 Fed. Rep. of Germany .
3012175 10/1981 Fed. Rep. of Germany .
3223461 12/1983 Fed. Rep. of Germany .
3639186 5/1988 Fed. Rep. of Germany .

*Primary Examiner*—Harold Broome

[57] ABSTRACT

An apparatus (1) for compensating the maladjustment of a power control means (2) by changes to the ambient temperature operates at least on a partial path against the flat spring (31) of a correcting device (30), after which at least part of the ambient temperature sensor (20) of the apparatus (1) is fixed against further deflection by a stop (34), so that the actual values of the power setting correspond to the set desired values substantially independently of the ambient temperature. For the correction spring (31) or for the stop (34) it is not necessary to provide a separate component, if use is made for the same of the already present twisting preventer (28) or a carrier (18).

28 Claims, 1 Drawing Sheet

DEVICE FOR CONTROLLING AN AMBIENT INFLUENCE ON EQUIPMENT

BACKGROUND OF THE INVENTION

The invention relates to a control device for equipment, whose working or operating characteristic is or is to be influenced by the ambient temperature thereof. Such equipment can e.g. be switching devices, such as switches, regulating or control devices, etc., which are used in such a way that they are exposed to varying ambient temperatures.

Operating switching devices of electric heating appliances, such as electric cookers, are usually located relatively close to the heating means to be operated therewith on the back of a switch shield and can consequently be exposed to varyingly high temperatures ranging from ambient temperature, e.g. roughly 20° C. to roughly 125° C. Thus, the switching characteristics can maladjust their switching device, e.g. influencing it in such a way that specific, manually settable switch positions can lead to heating levels completely different from those required. In this case a single or a plurality of control mechanisms is appropriately used for compensating the ambient temperature influence. It has been shown that at high ambient temperatures an overcompensation can occur, which leads to the full power being reached at an apparatus setting, which is below the setting for this maximum power.

DE-OS 31 03 561 discloses a compensating device for avoiding such disadvantages and which has proved to be very satisfactory. In this case the overcompensation is avoided in that the working or operating path of the temperature sensor of the compensating device is limited by a stop member on a correcting device. However, it has been found that for certain uses a still more precise matching of the switching characteristics of such switching equipment is appropriate.

OBJECTS OF THE INVENTION

An object of the invention is to provide an apparatus of the aforementioned type making it possible to avoid disadvantages of known constructions. Another object is to permit an increasingly precise influencing of the control characteristics of the ambient temperature sensor over a relatively large working path thereof. Further objects will be apparent from the description, effects, operating modes and advantages of the invention.

SUMMARY OF THE INVENTION

According to the invention the working or operating motion of a plurality or one single ambient temperature sensor can, as a function of the requirements to be placed on the switching characteristics, be influenced by same and/or opposite direction resilient action in the case of an increase and/or decrease of the ambient temperature and either over at least part and/or continuously over the entire associated working path and in a number of different ways, independently of such resilient elements, which can optionally be formed by an inherent resilience of at least one temperature sensor, a contact spring, a return spring, etc. and which consequently do not belong to the correcting device. The correcting working path can also be completely stopended and/or can be varyingly temperature-dependent to partial paths by varying the effective sensor length.

However, the inventive construction is particularly suitable for power control means according to U.S. Pat.

No. 4,829,279 to which reference should be made for including further details and effects into the invention. Such switching means supply the heating means with energy in periodic pulses, the relative cyclic duration factor being determined percentage wise by the sum of the switch-on times divided by the total time and can be manually adjusted. A control heating means periodically switched on and off with the pulses acts on a working sensor or working bimetal, which operates at least one working contact, such as a snap-action switch, in periodic manner by means of a contact spring.

However, it has been found that in the case of a non-linear characteristic of the system comprising the working and ambient temperature sensors between low and high relative cyclic duration factors and in particular at elevated ambient temperatures, there can be different expansions of the two sensors and therefore different control or compensation effects. Close to the low relative cyclic duration factor the working sensor operates relatively linearly, even at elevated ambient temperature, whereas in the upper range, e.g. at 40% relative cyclic duration factor it operates non-linearly. However, the ambient temperature sensor usually operates linearly when the working sensor has already reached the non-linear range, so that, compared with the desired or set value, there is an excessively high relative cyclic duration factor. This could admittedly be well compensated by undercompensated adjustment in the low relative cyclic duration factor range, but there is a need for an even more precise control or compensation.

In the case of such a power control means the correcting device is appropriately constructed in such a way that with a plurality of springs or a single spring separate from the aforementioned springs of the switching device it acts counter to the working movement of the ambient temperature sensor occurring with an increase of the ambient temperature. Advantageously the spring tension substantially continuously increases with increasing working path. This working movement of the ambient temperature sensor is appropriately opposite to the corresponding working sensor movement, so that in simple manner the desired compensating effect is obtained. As a result in the low relative cyclic duration factor range, namely if there is a relatively linear characteristic at high ambient temperature, the ambient temperature sensor operates against little or no counterforce and the latter increases with increasing relative cyclic duration factor and/or a further rising ambient temperature, so that said overcompensation is significantly reduced or completely avoided in this range.

Appropriately the ambient temperature sensor is not movable freely or against spring tension over all the ambient temperatures which occur and is instead stop-limited above a predetermined ambient temperature and/or above a given relative cyclic duration factor, so that a further deflection is at least reduced and an upward displacement of the relative cyclic duration factor is prevented by a positive fixing of at least part of the sensor. The inventive construction makes it possible with relatively marked differences of the ambient temperature between e.g. approximately 25° C. and 125° C., to obtain the same characteristics for the relative cyclic duration factor, based on essentially any manual equipment setting. This leads to a significant increase in the utilization value of very simply and inexpensively manufacturable, electromechanical power control means.

A significant constructional simplification is obtained if the correcting device is not formed by several springs, but by a single spring, e.g. a flat spring and optionally a stop member. If the spring is directly positioned between an outer face of the ambient temperature sensor and a spring abutment, the latter can simultaneously form the stop for the sensor path limitation. Instead of providing the control device and/or the correcting device on a wiper and/or a snap-action contact carrier movable or pivotable with a power adjusting shaft or the like, it is appropriately rigidly fixed with a carrier directly on an appliance socket or base, e.g. by inserting the carrier in corresponding mounting openings of a base or socket casing. In simple manner, the carrier can simultaneously form the abutment or the stop and with the two devices can be located in space-saving manner in a reentrant casing corner of the appliance socket or base.

A further significant simplification is obtained if the spring is formed substantially in one piece by an in any case present component of the appliance, so that no additional component is required. For example the spring can be punched in tongue-like manner from a locking member for an adjusting member.

BRIEF FIGURE DESCRIPTION

These and other features of the invention can be gathered from the claims, description and drawings and the individual features can be realized alone or in the form of subcombinations in an embodiment of the invention and in other fields and can represent advantageous, independently protectable constructions for which protection is hereby claimed. An embodiment of the invention is described in greater detail hereinafter relative to the drawings, wherein show:

DETAILED DESCRIPTION OF 4 PREFERRED EXAMPLE EMBODIMENTS

Figure 1:
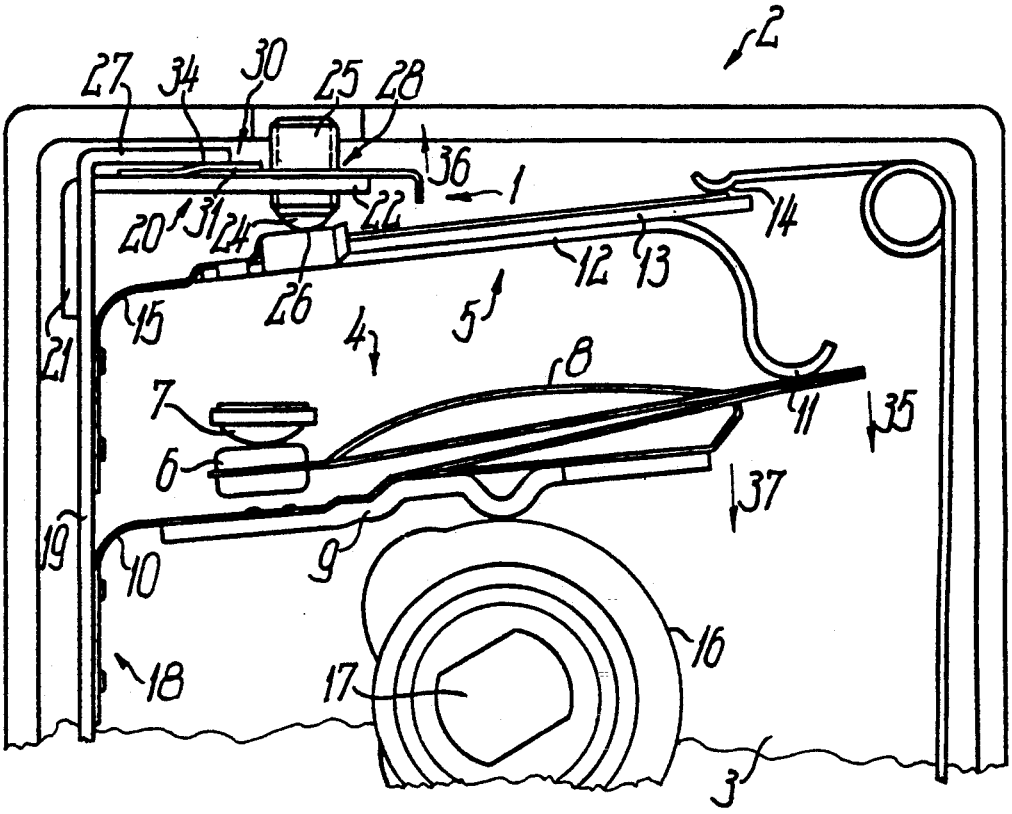

FIG. 1 an inventive control apparatus on a power control means shown in detail view form.

Figure 2:
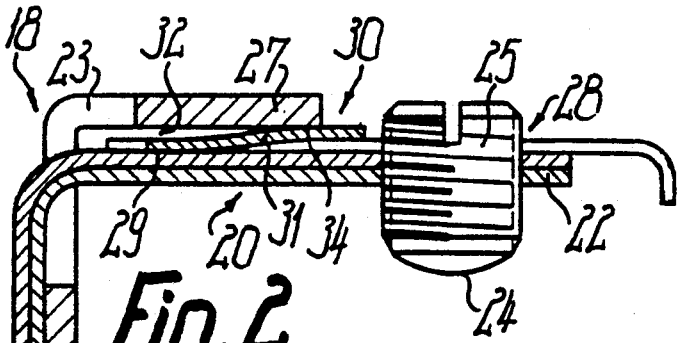

FIG. 2 a detail of FIG. 1 in a large-scale, sectional representation.

Figure 3:
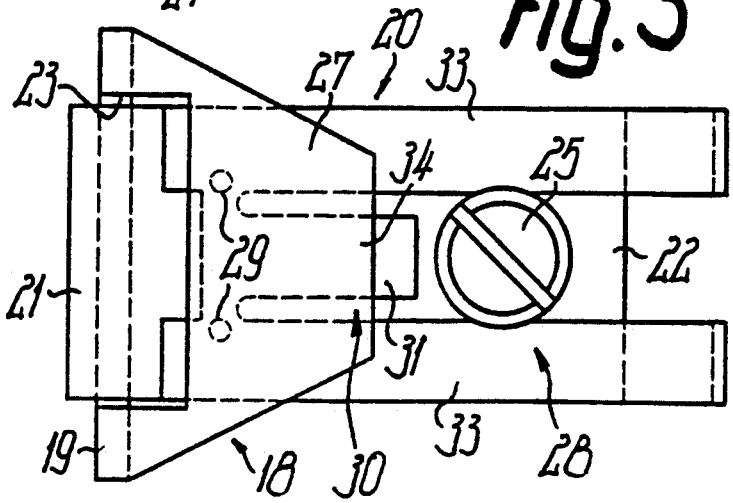

FIG. 3 the control apparatus according to FIG. 2 in plan view.

The inventive apparatus 1 is placed on a power control means 2, which has in a casing-like body 3 a power switch 4 for an electrical heating system of an electric hotplate or the like operated by a switching device 5. The switch 4 has a movable contact 6 cooperating by a timing movement with a fixed contact 7, which is placed by means of a snap-action spring 8 on a contact carrier 9 and whose relative cyclic duration factor can be modified by pivoting the contact carrier 9 about a joint 10. A trip cam 11 of a working sensor 12 engages on the end of the snap-action spring 8 remote from the contact 6 for this purpose and said sensor is deflected in opposite directions by a timing heating with a control heating means 13. The control heating means 13 fixed to the working sensor 12 is connected at its end associated with the trip cam 11 by means of a sliding and resiliently engaging connecting contact 14 and at its other end via a joint 15 to a circuit, which pivotably carries the working sensor 12 about an axis roughly parallel to the joint 10.

The switch 4 and switching device 5 or snap-action spring 8, the contact carrier 9, the working sensor 12 and/or the control heating means 13 in each case define a plane parallel to the associated joint 10 or 15 and/or to one another. On the side remote from the thermomechanical switching device 5 engages on the contact carrier 9 in the form of the adjusting member 16 of an adjusting device a circumferential cam curve, which is located on a manually operable adjusting or control shaft 17 and with which, other than in an open off-position, the contact 6 can be continuously adjusted in different power stages. The joints 10, 15 are formed by spring joints, which press the carrier 9 with a running cam against the adjusting member 16 and the trip cam 11 constructed in one piece with the working sensor 12 in the same direction against the contact or snap-action spring 8. The contact 7 is located between the contact 6 and the switching device 5 or the control apparatus 1.

The contact carrier 9 and the working sensor 12 are fixed by means of the joint 10 or 15 to a common carrier 18, which serves as an electrical connection for the contact 6 and the control heating means 13 and also carries the control apparatus 1. The carrier 18 is essentially formed by an angular strip plate 19, which is fixed adjacent to a casing inner wall of the body 3 solely by insertion in openings of its base wall and an electric connecting member, e.g. a flat connecting tongue projecting over the outside of said base wall. In the vicinity of its bent end the carrier 18 carries the apparatus 1, which defines a plane roughly parallel to the said joint axes and/or planes and is located on the side of the switching device 5 remote from the switch 4 between its wiper and the casing wall parallel thereto.

The control apparatus 1 has an ambient temperature sensor 20 located roughly in said plane. The working sensor 12 and/or the sensor 20 is in each case formed by two cooperating members with different thermal expansion coefficients, preferably by a strip-like and optionally once or more times bent thermobimetal. Both sensors are exposed in the same way to the ambient temperature acting on or prevailing in the device 2. However, the action or deflection thereof is oppositely directed with increasing temperature on the one hand and decreasing temperature on the other, so that deflections of the trip cam due to changes in the ambient temperature are compensated by opposite deflections of an actuator 24 of the apparatus 1.

The bent region of the angular sensor 20 passes through an opening 23 in the bent region of the carrier 18 and is fixed, e.g. by welding, by its shorter leg 21 to the side of the carrier 18 remote from the switch 4 or the switching device 5. The longer leg 22 of the sensor 20 projecting freely in roughly the same direction as the contact carrier 9 or the working sensor 12 carries in the vicinity of its end the actuator 24, which is formed by the convex end of an adjusting member 25 adjustable roughly in the actuating direction with respect to the sensor 20. This adjusting member 25 is constructed as a stud, which is accessible for adjustment purposes at one end through an opening from the outside of the body 3, passes through a taphole in the leg 22 and engages with the other end by pressure only on a pressure surface 26 of the wiper. This pressure surface 26 is located between the trip cam 11 and the joint 15 on the side of the working sensor 12 remote from the switch 4.

On the side of the sensor 20 or the leg 22 remote from the switching device 5 is provided the shorter leg 27 of the carrier 18, which projects freely in roughly the same direction as the leg 22, but terminates at a short distance in front of the adjusting member 25. This carrier leg 27 can be supported on the associated outer wall of the body 3 or can have a limited spacing therefrom and in this case it is appropriately substantially rigid. A twisting preventer 28 acting non-positively by friction is provided for the adjusting member 25 and can only overcome a predetermined rotary or twisting force acting on the adjusting member 25. This twisting preventer 28 is essentially formed by a sheet metal leaf spring, which is approximately flat and engages substantially flat on the sensor leg 22 on the side remote from the switching device 5. The leaf spring is provided with a longitudinal passage slot for the adjusting member 25 and with the facing longitudinal boundaries of said slot engages in locking manner in the threads of the adjusting member 25.

At a distance from the adjusting member 25 the leaf spring is fixed, e.g. by spot welding in positionally rigid manner to the sensor leg 22 between the adjusting member 25 and the fastening of the sensor 20 to the carrier 18 by fastenings 29. Thus, the twisting preventer 28 forms a wiper projecting freely in roughly the same direction as the leg 22, but engaging substantially flat on the latter. The free end of the wiper can project longitudinally over the free end of the leg 22 and can be bent at the end, the fork arms of the twisting preventer 28 at said end can project freely towards one another in spaced manner instead of being interconnected. The fastenings 29 are appropriately located in the vicinity of the other end of the longitudinal slot or at a limited distance therefrom.

The temperature-dependent deflections of the working sensor 12 and the sensor 20, like the common deflection of the sensor system formed by these sensors is not determined by linear characteristics. To influence the common characteristic in the direction of a linear levelling, a correcting device 30 is provided, which is constructionally combined with the control apparatus 1 and forms with the latter a closed subassembly. The correcting device 30 mounted with the carrier 18 is located on the side of the switching device 5 or the sensor 20, or the leg 22 remote from the switch 4 and appropriately substantially between said leg and the carrier leg 27.

It has as the correcting member a spring 31, e.g. a leaf spring, which is substantially located in a plane roughly parallel to at least one of the said planes and can project in the manner of a spring tongue freely in the direction of the actuator 24 or the adjusting member 25. The spring 31 arranged substantially completely between the actuator 24 and the strip plate 19 of the carrier 18 has a spacing 32 formed between the sensor leg 22 or the body of the twisting preventer 28 and the carrier leg 27. The spring 31 which is only very slightly curved in S-shaped manner in cross-section at normal temperature and only deflected by its sheet metal thickness can project further longitudinally than the carrier leg 27.

The spring 31 is shaped in one piece from the twisting preventer 28, is positioned between its fork arms 33 in a longitudinal slot and has a smaller width compared therewith. The spring root of the spring 31 remote from the free end passes, adjacent to the fastenings 29, in one piece into the twisting preventer 28, so that its end is fixed by the fastenings 29 in a substantially immovable manner with respect to the sensor 20. The twisting preventer can have roughly the same width as the sensor 20, so that it is approximately congruent to the leg 22. The spring 31 rises in a shallow curved manner to the carrier leg 27 from the vicinity of the fastening 29 and engages thereon with its other curvature arc in a substantially constant manner with pretension. For this engagement the outer face of the carrier leg 27 facing the sensor 20 forms a stop 34 constructed as a sliding surface. Towards its free end, the width of the carrier leg 27 can be reduced, e.g. being trapezoidally constructed in such a way that it passes with its trapezium base into the strip plate 19. The sensor leg 22 projects with the actuator 24 freely over the stop 34.

The spring 31 loads the sensor 20 opposite to the direction of the arrow 36, in which it is deflected on increasing the ambient temperature away from the pressure surface 26. On increasing the ambient temperature the trip cam 11 is deflected in opposition to the direction of arrow 35 towards the adjusting member 16. In substantially the same direction as arrow 37 the contact carrier 9 and the adjusting member 16 are moved if the relative cyclic duration factor is to be increased, because then, under the action of the control heating means 13, the trip cam 11 must perform a longer trip path until the contacts 6, 7 are opened and the working and control circuit is interrupted.

If the ambient temperature increases, the sensor 20 is deflected in opposition to the tension of the spring 31 under bending deformation, the spring tension also increasing with rising deflection. The distance from the stop 34 to the associated side of the twisting preventer 28 or the spring 31 determines the maximum deflection, at whose end the spring 20, whilst interposing the twisting preventer 28, or the spring 31 strikes against the stop 34 and is rigidly secured against further deflection by the associated longitudinal portion connected to the carrier 18. Optionally the longitudinal portion of the sensor leg 22 freely projecting over the stop 34 can be constructed in such a way that with the actuator 24 it can still perform a further deflection, so that there is a corresponding correction characteristic of said deflection. The specific deflection of the residual portion of the sensor 20 would in this case be much smaller than that of the complete sensor 20 prior to the stop limitation.

The spring tensions exerted by the connection contact 14, the joints 10, 15, the snap-action spring 8, the wipers and similar components of the switching means 2 can also have an action on the characteristic, but not in the sense of the correcting device 30, because they either do not act directly on the characteristic of the control apparatus 1 or permit no precise measurement. In the stop position of the ambient temperature sensor 20 the correction spring 31 is pressed substantially flat, so that it is located between the fork arms 33 in the plane of the twisting preventer 28, so that the correcting device 30 can be made even more compact.

What we claim is:

1. A control device for compensating for an ambient temperature influence on operating equipment, the operating equipment including a switch having a conducting contact electrically connected to a bistable spring arm and a pivoting working sensor engaging said bistable spring arm to switch said conducting contact between a first connecting position and a second disconnect position according to a non-ambient temperature, said control device comprising:

an ambient temperature sensor including two cooperating members with different thermal expansion coefficients operationally connected to said working sensor to compensate said working sensor for an ambient temperature by moving along a compensating path; and correcting means associated with said ambient temperature sensor to correct for non-linear characteristics associated with said ambient temperature sensor and said working sensor by resiliently opposing said ambient temperature sensor along at least one direction of said path.

2. The device according to claim 1, wherein said correcting means counteracts said ambient temperature sensor in a direction corresponding to an increase of the ambient temperature.

3. The device according to claim 1, wherein said correcting means has a spring tension and further comprising means for varying the spring tension as a function of a distance moved along said direction by said ambient temperature sensor.

4. The device according to claim 3, wherein said varying means increases the spring tension in accordance with a rise of the ambient temperature.

5. The device according to claim 1, wherein said compensation path is stopped before continuing operating tensions of said ambient temperature sensor reach a maximum.

6. The device according to claim 5, wherein said compensation path is stop-limited above a pre-determined ambient temperature.

7. The device according to claim 1 wherein said correcting means has at least one correcting spring.

8. The device according to claim 7, wherein said at least one correcting spring is a flat leaf spring.

9.The device according to claim 7,wherein said at least one correcting spring is directly supported against said temperature sensor.

10. The device according to claim 7, wherein said at least one correcting spring is supported on an abutment operationally fixed with respect to a mounting carrier for said ambient temperature sensor.

11. The device according to claim 7, wherein said at least one correcting spring is located with a flat portion in a gap between an abutment and said ambient temperature sensor.

12. The device according to claim 1, wherein said ambient temperature sensor includes a bimetal.

13. The device according to claim 1, wherein said ambient temperature sensor has sensor legs at angles to each other.

14. The device according to claim 13, wherein said ambient temperature sensor is fixed with one of said legs to a mounting carrier, a further one of said legs projecting substantially freely.

15. The device according to claim 14, wherein said correcting means engages said further one of said legs for correctingly operating said switch.

16. The device according to claim 10, wherein said mounting carrier has an angular construction and is formed by an angular strip plate.

17. The device according to claim 10, wherein said mounting carrier has at least one leg providing said abutment.

18. The device according to claim 10, wherein said mounting carrier has an opening traversed by said ambient temperature sensor.

19. The device according to claim 7, wherein a portion of said at least one correcting spring is fixed with respect to said ambient temperature sensor substantially free of motion play.

20. The device according to claim 7, wherein a portion of said at least one correcting spring is fixed to said ambient temperature sensor by a solidified bonding joint.

21. The device according to claim 10, wherein said at least one correcting spring is supported on said abutment only by freely resting counter-contact.

22. The device according to claim 7, wherein said at least one correcting spring has a shallow S-shaped curvature between supporting engagement with said ambient temperature sensor and a counter-abutment.

23. The device according to claim 1, wherein over a spring portion of said at least one correcting spring (31) projects a flat fork having fork arms (33) engaging in a threaded portion of said adjusting member (25).

24. The device according to claim 7, wherein said at least one correcting spring forms a tongue-shaped projection providing a stamped and bent portion of a sheet metal part, said at least one correcting spring and said metal part being commonly connected to said ambient temperature sensor (20).

25. The device according to claim 7, wherein said at least one correcting spring is located substantially on a side of said ambient temperature sensor remote from said switch.

26. The device according to claim 1, wherein said ambient temperature sensor has an actuator directly supported on a switching arm of said working sensor, said switching arm at least partly being formed by a periodically heatable operating bimetal.

27. The device according to claim 10, wherein said abutment forms a stop for reducing an operating motion of said ambient temperature sensor.

28. The device according to claim 11, wherein said abutment forms a stop for reducing an operating.

* * * * *

UNITED STATES PATENT AND TRADEMARK OFFICE

CERTIFICATE OF CORRECTION

PATENT NO. : 5,237,303

DATED : August 17, 1993

INVENTOR(S) : Kicherer et al.

It is certified that error appears in the above-identified patent and that said Letters Patent is hereby corrected as shown below:

Column 8, line 51, after "operating" insert --motion of said ambient temperature sensor--.

Signed and Sealed this

Twenty-sixth Day of April, 1994

*Attest:*

Bruce Lehman

BRUCE LEHMAN

*Attesting Officer*

*Commissioner of Patents and Trademarks*